US005265026A

United States Patent [19]

Nishizawa et al.

[11] Patent Number: 5,265,026

[45] Date of Patent: Nov. 23, 1993

[54] SEWING MACHINE CONTROL DEVICE

[75] Inventors: Yoshifumi Nishizawa; Satomi Yamauchi, both of Aichi, Japan

[73] Assignee: Mitsubishi Denki K.K., Tokyo, Japan

[21] Appl. No.: 643,247

[22] Filed: Jan. 18, 1991

[30] Foreign Application Priority Data

Mar. 9, 1990 [JP] Japan ..... 2-59737

[51] Int. Cl.[5] ..... D05B 23/00; G08B 21/00

[52] U.S. Cl. ..... 364/470; 364/185; 364/188; 112/277; 112/121.11; 340/679

[58] Field of Search ..... 364/470, 184, 185, 188, 364/189; 371/29.1; 112/121.11, 273, 277, 278, 445, 403, 444; 340/691, 679

[56] References Cited

U.S. PATENT DOCUMENTS 4,301,755 11/1981 Kato et al. ..... 112/444
4,469,038 9/1984 Fujikawa ..... 112/121.11
4,481,507 11/1984 Takiguchi et al. ..... 364/470
4,498,078 2/1985 Yoshimura et al. ..... 364/470
4,531,466 7/1985 Hanyu et al. ..... 112/121.11
4,869,184 9/1989 Hisatake et al. ..... 364/470
4,901,656 2/1990 Yoshida ..... 112/121.11
5,078,067 1/1992 Nakashima ..... 112/121.11

*Primary Examiner*—Jerry Smith
*Assistant Examiner*—Steven R. Garland
*Attorney, Agent, or Firm*—Sughrue, Mion, Zinn, Macpeak & Seas

[57] ABSTRACT

A sewing machine control device for controlling the drive of a sewing machine. The sewing machine control device is provided with a monitoring device having a display device for displaying data to identify the direction of rotation and abnormal conditions of the sewing machine.

11 Claims, 10 Drawing Sheets

| | TIME $T_1$ (ms) | NO. N |
|---|---|---|
| LED K | 20 | 1 |
| LED L | 30 | 2 |
| LED M | 40 | 3 |
| LED N | 50 | 4 |
| LED O | 60 | 5 |
| LED P | 70 | 6 |
| LED Q | 80 | 7 |
| LED R | 90 | 8 |

FIG. 12

| | 7 SEGMENTS DISPLAY |
|---|---|
| LED S | 1 |
| LED T | 2 |
| LED U | 3 |
| LED V | 4 |
| LED W | 5 |
| LED X | 6 |
| LED Y | 7 |
| LED Z | 8 |

SEWING MACHINE CONTROL DEVICE

BACKGROUND OF THE INVENTION

This invention relates to a sewing machine control device for controlling the drive of a sewing machine, and more particularly to a sewing machine control device for displaying data to identify the direction of rotation and abnormal conditions of the sewing machine.

FIG. 1 is an explanatory diagram showing the entire arrangement of a conventional sewing machine control device. In FIG. 1, reference numeral 1 designates a sewing machine body; 2, an electric motor for driving the sewing machine 1; 3, a control device for controlling the operation of the motor 2; 4, a pedal for specifying a speed for the sewing machine; 5, a display unit for displaying abnormal conditions; and 6, a table on which the sewing machine body 1 is mounted.

The conventional sewing machine control device is arranged as described above. Depending on the amount of depression of the pedal, a rotation instruction signal is applied to the control device 3, whereupon the control device 3 applies a signal to the motor 2 which is based on the rotation instruction signal. As a result, the motor 2 is rotated to drive the sewing machine body.

When an abnormal condition occurs within the sewing machine body 1 or the control device 3 while the sewing machine body 1 and the motor 2 are being driven, an alarm is given with a warning signal displayed on the display unit 5.

The conventional display unit 5 is provided with several light emitting diodes (hereinafter referred to as "LEDs", when applicable) to identify abnormal conditions, or it is provided with a 7-segment LED numeric display panel to display digits to identify abnormal conditions.

Only when the sewing machine is rotated in the forward direction, the direction of rotation is displayed—when it is rotated in the reverse direction, the direction of rotation is not displayed.

With the conventional sewing machine control device, erroneously the sewing machine may be rotated continuously in the reverse direction to damage it, because it is impossible for the operator to determine with a glance whether the sewing machine is rotated in the forward direction or whether it is rotated in the reverse direction.

In the case where LEDs are employed to display the occurrences of abnormal conditions, different LEDs must be provided for different warning signals, and therefore it is necessary to increase the installation space for the display unit as much.

The same thing can be said about the case where a 7-segment LED panel is employed.

Thus, the display unit is unavoidably bulky, and accordingly high in manufacturing cost.

SUMMARY OF THE INVENTION

Accordingly, an object of this invention is to eliminate the above-described difficulties accompanying a conventional sewing machine control device. More specifically, an object of the invention is to provide a sewing machine control device in which means can be readily installed which can display a number of warning signals representing abnormal conditions with only one display unit, and can display the direction of rotation of the sewing machine even when the machine is rotated in the reverse direction, and can display abnormal conditions using characters, symbols, etc.

The foregoing object of the invention has been achieved typically by the provision of the following sewing machine control devices.

One of the sewing machine control devices, according to a first aspect of the invention, comprises: memory means in which data corresponding to the abnormal conditions of a sewing machine have been stored; an arithmetic device which is adapted to receive warning signals representing the abnormal conditions from sensors provided for the sewing machine, and which, upon reception of any one of the warning signals, reads data corresponding to the warning signal from the memory means, to provide an output signal having a predetermined waveform based on the data; and a display device which turns on or off a display unit according to the waveform of the output signal provided by the arithmetic device, or repeatedly flicker the display unit with a period according to the waveform of the output signal.

The other sewing machine control device, according to a second aspect of the invention, comprises: a first display device which flickers repeatedly with predetermined periods to display the abnormal conditions of the sewing machine; a second display device for displaying the abnormal conditions of the sewing machine by using characters, symbols, etc.; memory means in which first data have been stored which apply signals to the first display device to flicker the first display device in correspondence to the abnormal conditions of the sewing machine to the first display device, and in which second data have been stored which apply, as display data for the second display device, signals higher in frequency than the signals for flickering the first display device in correspondence to the abnormal conditions of the sewing machine; and an arithmetic device which receives warning signals indicating the abnormal conditions of the sewing machine from sensors, and which, upon reception of any one of the warning signals with the first or second display device not connected, reads data corresponding to the warning signal out of the second or first data in the memory means, to apply a signal based on the data thus read to the second or first display device, and upon reception of any one of the warning signals with the first and second display devices connected, reads data corresponding to the warning signal from the first and second data in the memory means, to produce a signal based on the data thus read as display data for the first and second display devices.

In the sewing machine control device according to the invention, the arithmetic device is adapted to receive the warning signals indicating the abnormal conditions of the sewing machine from the sensors, and upon reception of any one of the warning signals, the data corresponding to the warning signal is read from the memory means, as a result of which the output signal is produced which has a waveform based on the data thus read.

Hence, the abnormal conditions of the sewing machine can be recognized, for instance, with only one display unit provided in the display device.

With the control device, the directions of rotation of the sewing machine are also displayed. However, it should be noted that the warning signals are displayed in preference to the signals representing the directions of rotation.

Furthermore in the control device, the display device for flickering to display the abnormal conditions of the sewing machine and/or the display device for displaying them by using characters, symbols, etc. can be provided with ease.

BRIEF DESCRIPTION OF THE DRAWINGS

In the accompanying drawings:

FIG. 2 is an explanatory diagram showing the arrangement of a sewing machine according to a first aspect of the invention;

FIG. 3 is a block diagram showing the arrangements of memory means, an arithmetic device, and a display device in a control device shown in FIG. 2;

FIG. 4 is a flow chart for selection of a light emission pattern for the LED in the display device;

FIG. 5 is a characteristic diagram showing light emission patterns provided for the LED;

FIGS. 6 through 12 are diagram for a description of a second embodiment of the invention, FIG. 6 is an explanatory diagram showing the arrangement of a sewing machine according to a second aspect of the invention;

FIG. 7 is a block diagram showing the arrangements of display devices and arithmetic devices in the second embodiment;

FIG. 8 is a flow chart for a description of the operation of the arithmetic device A;

FIG. 9 is a characteristic diagram showing light emission patterns provided for the display device A when the display device B is not connected;

FIGS. 10(*a*) and 10(*b*) is a diagram showing light emission patterns provided for the display device B when the latter is connected;

FIG. 11 is a flow chart for a description of the operation of the arithmetic device B; and FIG. 12 is a diagram showing characters displayed by the display device B.

DESCRIPTION OF THE PREFERRED EMBODIMENTS

Figure 1:
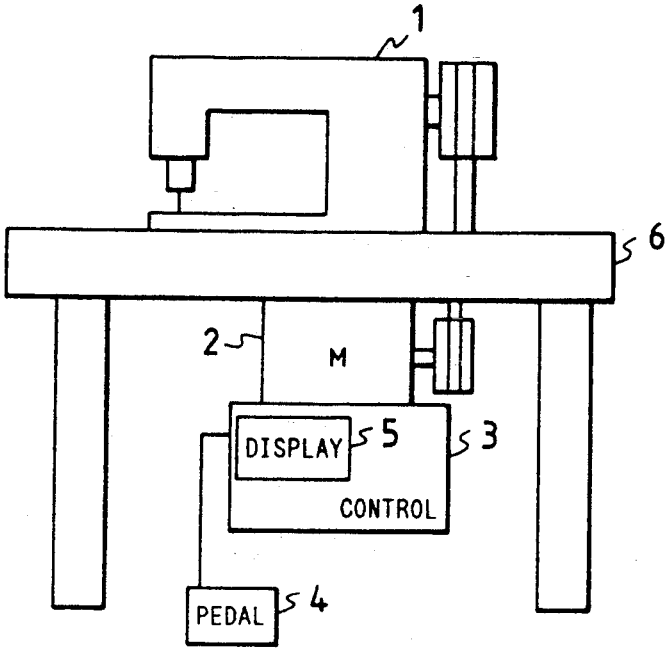
FIG. 1 PRIOR ART
FIG. 1 is an explanatory diagram showing the arrangement of a conventional sewing machine.
Figure 2:
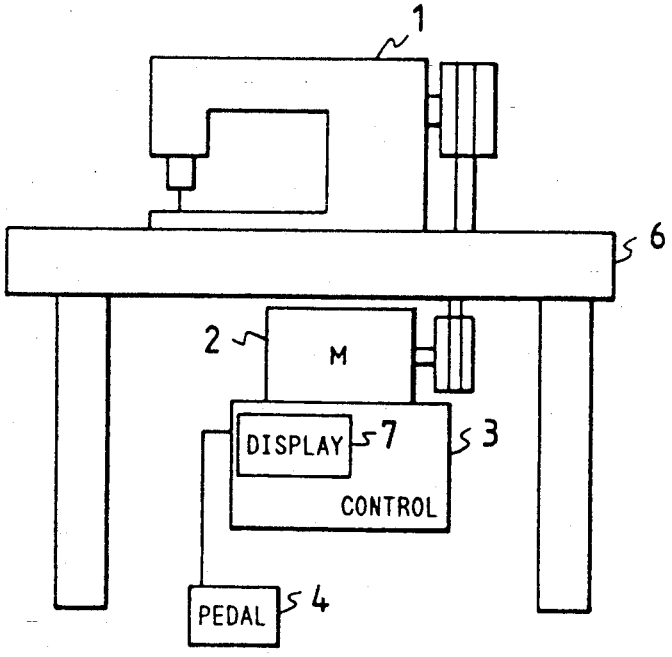
FIGS. 2 through 5 are diagrams for a description of a first embodiment of this invention.

FIG. 2 shows the entire arrangement of one embodiment of this invention. In FIG. 2, reference numerals I through 4 and 6 designate the same items as those in FIG. 1; and reference numeral 7 designates a display device which is provided in the control device 3, to display the directions of rotation of the sewing machine and various abnormal conditions on one display unit.

Figure 3:
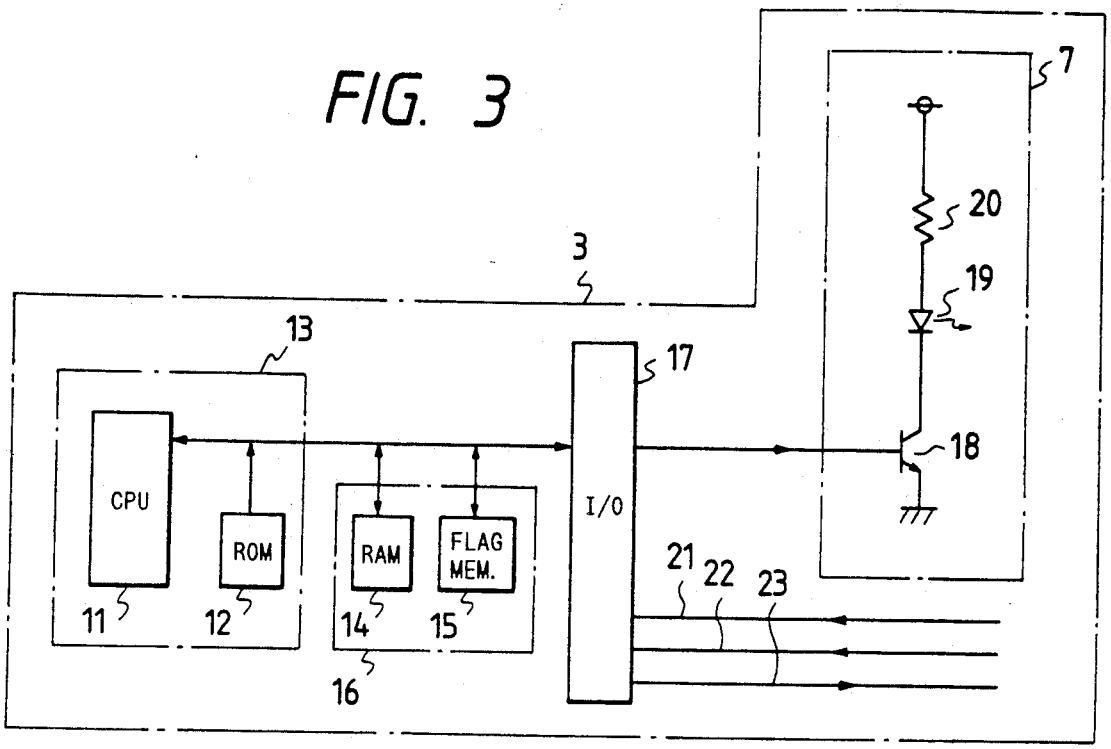

FIG. 3 is a block diagram showing the arrangements of memory means, an arithmetic device and the display device which are included in the control device 3. In FIG. 3, reference numeral 11 designates a CPU which reads a program in correspondence to an input signal and reads data from the memory means to provide an output signal having a predetermined waveform according to the data thus read; 12, a ROM in which programs have been stored; and 13, the aforementioned arithmetic device comprising the CPU 11 and the ROM 12.

Further in FIG. 3, reference numeral 14 designates a RAM for storing data corresponding to an input signal, to which access can be made for reading and writing data; 15, a flag memory in which, when a signal representing the direction of rotation of the sewing machine is provided or a warning signal indicating an abnormal condition is provided by any one of the sensors, the corresponding flag is set to "1"; and 16, the aforementioned memory means comprising the RAM 14 and the flag memory 15.

Further in FIG. 3, reference numeral 17 designates an input/output means through which data are transmitted between the CPU 11 and external equipment (hereinafter referred to as input/output port 17, when applicable); 18, a transistor for driving an LED in response to an output signal of the arithmetic device 13; and 19, the LED which is driven by the transistor 18 to emit light.

Still further in FIG. 3, reference numeral 20 designates a resistor for limiting the current in the LED 19; 21, a signal indicating the direction of rotation of the sewing machine; 22, a warning signal indicating an abnormal condition provided by any one of the sensors; and 23, a stop signal for stopping the driving of the sewing machine.

Figure 4:
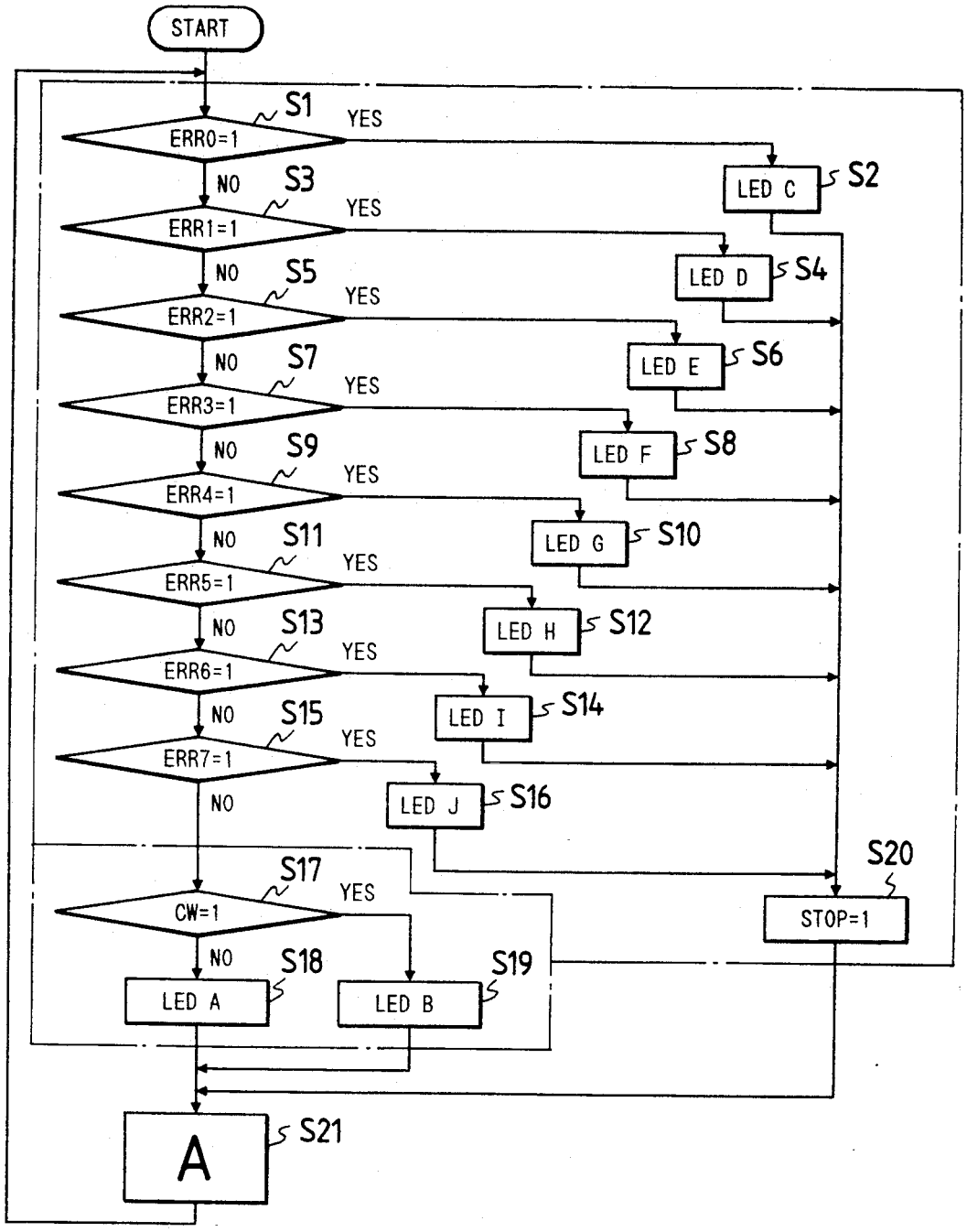

FIG. 4 is a flow chart showing the operation of causing the LED 19 to emit light in a predetermined pattern when the flag is "1" which corresponds to the signal 21 indicating the direction of rotation of the sewing machine 1 and the warning signal 22 indicating an abnormal condition provided by any one of the sensors.

Figure 5:
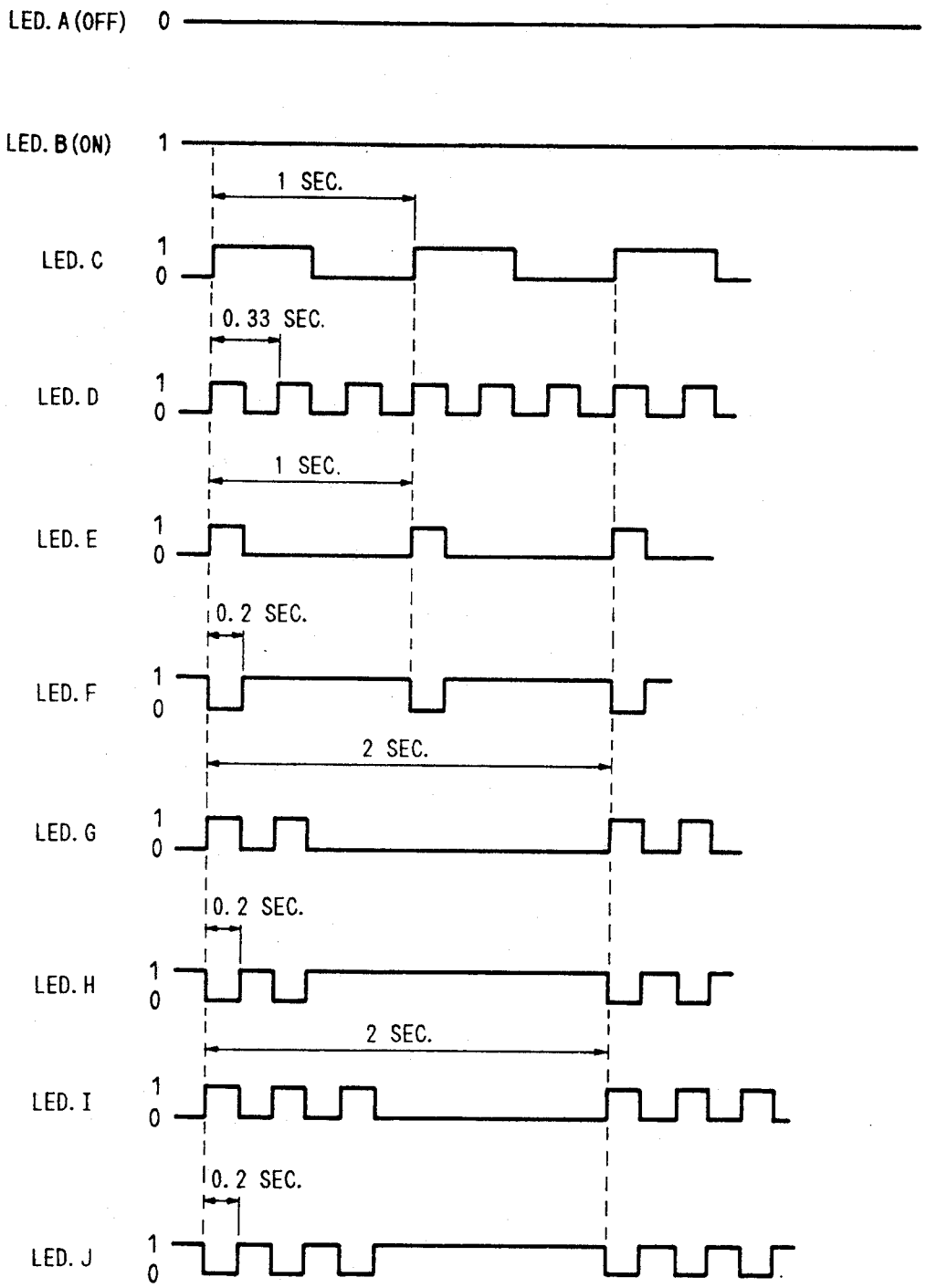

FIG. 5 is a characteristic diagram showing the waveforms of the light emission patterns of the LED 19 which is operated according to FIG. 4. In FIG. 5, reference character LED.A designates the waveform provided when the sewing machine is rotated in the reverse direction; LED.B, the waveform provided when the sewing machine is rotated in the forward direction; and LED.C through LED.J, the light emission waveforms provided in response to the abnormal conditions detected by the sensors, respectively.

The operation of the sewing machine control device thus organized will be described with reference to FIGS. 1 through 4.

The motor 2 is rotated according to the amount of depression of the pedal 4, to drive the sewing machine body 1.

When an abnormal condition occurs during the operation of the sewing machine, the respective sensor detects it to apply the warning signal 22 through the I/0 port to the arithmetic device 13.

Upon reception of the warning signal 22, the arithmetic device 13 eliminates the output signal indicating the direction of rotation of the sewing machine which has been displayed and reads data corresponding to the warning signal 22, thereby to produce the output signal which has a predetermined waveform based on the data thus read.

The output signal drives the transistor 18, so that the LED 19 is flickered with a period corresponding to the operation of the transistor 18, to inform the operator of the location where the abnormal condition has occurred.

At the same time, the arithmetic device 13 provides the stop signal to stop the driving of the sewing machine.

A method of forming the patterns of light emission of the LED 19 in response to the abnormal conditions detected by the sensors will be described in detail.

When the warning signal is produced, the error flag in the flag memory 15 corresponding to the warning signal is set to "1" in advance. When a warning signal 22 is produced, the CPU reads the error flags in the flag memory 15 successively to detect whether each of the error flags is "1" or "0" (Steps S1, S3, S5, . . . and S15).

When the CPU detects an error flag "0", it operates as required for the error flag (Steps S2, S4, S6, . . . and S16).

For instance when the error flag ERR3 is "1" (Step S7), the CPU 11 reads the data corresponding to the error flag ERR3 from the RAM 14 in the memory means 16, thereby to produce the output signal which has the waveform based on the data thus read, as a result of which the LED 19 is caused to flicker in the pattern LED.F based on the waveform.

The LED 19 has the following light emission patterns in correspondence to the error flags:

| ERROR FLAG | LED LIGHT EMISSION PATTERN |
|---|---|
| ERR0 - 1 | LED.C |
| ERR1 - 1 | LED.D |
| ERR2 - 1 | LED.E |
| ERR3 - 1 | LED.F |
| ERR4 - 1 | LED.G |
| ERR5 - 1 | LED.H |
| ERR6 - 1 | LED.I |
| ERR7 - 1 | LED.J |

Thereafter, the CPU 11 performs an arithmetic operation "A" to control the sewing machine (Step S21). If, in this case, the stop has been set to "1", then the CPU 11 outputs the stop signal 23 to stop the sewing machine.

When the sewing machine is in good condition, the signal 21 indicating the direction of rotation of the sewing machine is applied through the I/O port 17 to the arithmetic device 13.

Upon reception of the signal 21, the arithmetic device 13 reads the data corresponding to the direction of rotation of the sewing machine from the memory means 16, and produces the output signal which has the waveform based on the data.

The output signal drives the transistor 18, which is adapted to drive the display device 7, so that the LED 19 is operated according to the operation of the transistor 18.

Now, a method of forming the patterns of light emission of the LED according to the direction of rotation of the sewing machine will be described in detail.

Upon production of a signal 21, in the flag memory 15 the flag corresponding to the signal 21 is set to "1" or "0" in advance.

The CPU 11 reads the flags in the flag memory 15 of the memory means 16 successively to check the error flags (Steps S1, S3, S5, . . . and S15), to determine whether the flag CW corresponding to the direction of rotation of the sewing machine is "1" or "0" (Step S17).

When the flag CW is "0" (Step S17), the CPU 11 reads the data corresponding thereto from the RAM 14 in the memory means 16, and outputs the waveform LED.A indicating the fact that the sewing machine is rotated in the reverse direction, and turns off the LED 19 (Step S18).

When the flag CW is "1" (Step S17), the CPU 11 reads the data corresponding thereto from the RAM 14 in the memory means 16, and outputs the waveform LED.B indicating the fact that the sewing machine is rotated in the forward direction, and turns on the LED 19 (Step S19).

After the direction of rotation has been displayed by turning on or off the LED 19, the arithmetic operation "A" is carried out to control the sewing machine (Step S21), and then Steps S1 through S21 are carried out again.

In the above-described embodiment, the display device 7 employs the LED 19; however, a lamp or the like may be employed to indicate the direction of rotation of the sewing machine and the abnormal conditions.

Furthermore in the embodiment, ten light emission patterns are provided for the LED 19; however, this function may be accomplished by provision of two light emission patterns for indicating the directions of rotation of the sewing machine and one light emission pattern used when an abnormal condition occurs.

In addition, ten light emission patterns are employed for the LED 19 as was described above; however, the invention is not limited thereby or thereto. That is, more than ten light emission patterns may be employed if they can be visually read by a person.

With respect to the sewing machine abnormal condition display device, depending on users, sometimes it is required to provide, together with the sewing machine abnormal condition display device, a sewing data setting and displaying unit on the sewing machine table to set and display sewing data.

The sewing data setting and displaying unit has a display section for displaying characters, symbols, etc. Hence, in this case, the kind of abnormal condition can be read more readily than in the case where an abnormal condition of the sewing machine is indicated by flickering the LED 19 in the predetermined pattern.

In the above-described case, the LED 19 is flickered to inform the operator of the occurrence of an abnormal condition with the sewing machine, and for this purpose the low frequency signals as shown in FIG. 5 are used. Therefore, in the case where the signals are used to display characters, symbols, etc. to indicate the occurrences of abnormal conditions, and the kinds of abnormal conditions should be read, it is necessary to input the signals a certain number of times. Thus, indication of the abnormal condition takes a relatively long period of time.

Figure 6:
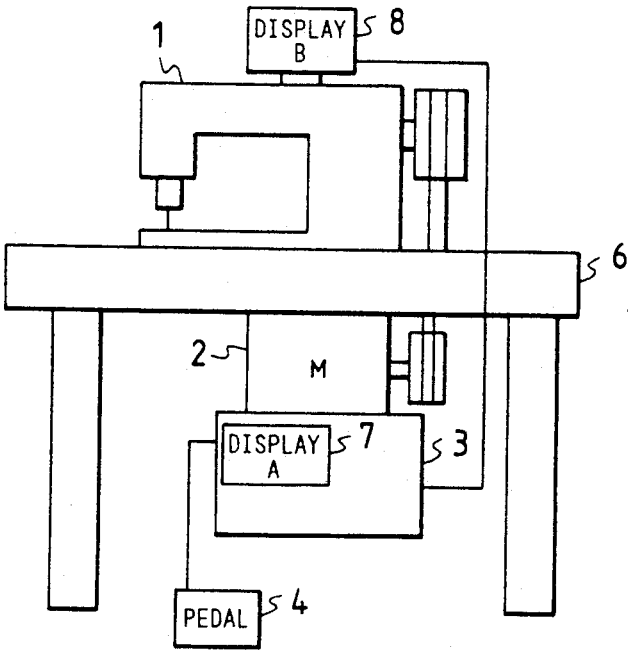

FIG. 6 shows the entire arrangement of a sewing machine, a second embodiment of the invention. In FIG. 6, references numerals 1 through 4 and 6 designate the same items as those in FIG. 1 (the prior art).

Further in FIG. 6, reference numeral 7 designates a first display device, namely, a display device A which is provided in the control device 3, to display the directions of rotation and the abnormal conditions of the sewing machine by using one display element (or LED); and 8, a second display device, namely a display device B which is provided outside the control device 3, to display abnormal conditions.

The display device B is not one additionally provided; that is, it is a display section for displaying sewing data such as sewing patterns. It is mounted on the head of the sewing machine so that the operator can observe it with ease.

Figure 7:
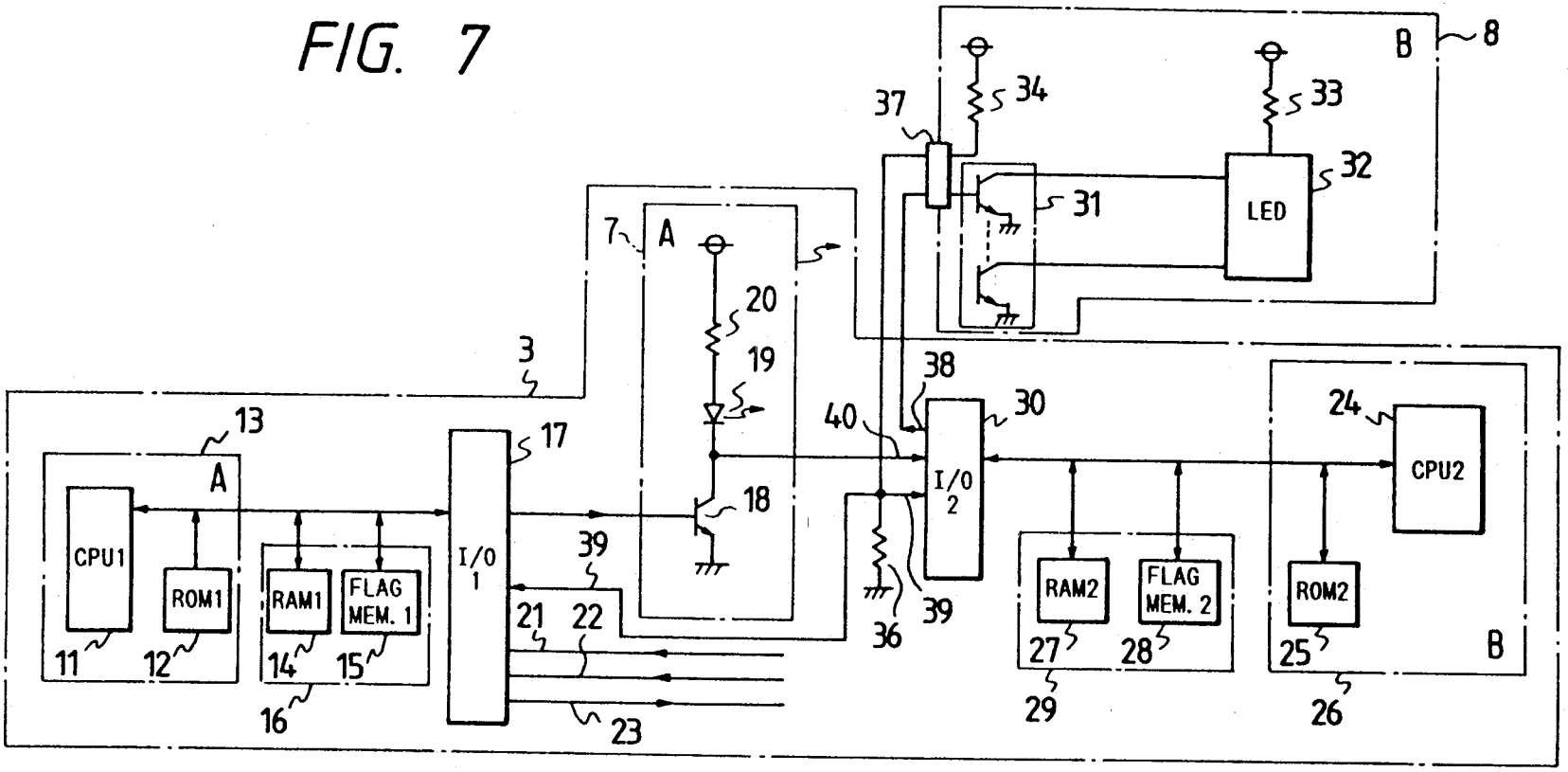

FIG. 7 is a block diagram showing the arrangements of memory means, arithmetic devices A and B, and the display device A which are provided in the control device 3, and of the display device B provided outside the device 3. In FIG. 7, reference numerals 11 through 23 designate the same items as those in FIG. 3.

Further in FIG. 7, reference numeral 24 designates a second CPU which reads a program corresponding to an input signal, and reads data from memory means B 29, thereby to produce the output signal 38 which has the meaning based on the data thus read; 25, a second ROM for storing programs; and 26, an arithmetic device B comprising the second CPU and the second ROM 25.

Further in FIG. 7, reference numeral 27 designates a second RAM which stores data corresponding to input signals, and to which access can be made to read or write data; 28, a second flag memory in which, when the CPU 1 provides an abnormal-phase signal 40 indicating an abnormal condition, the flag corresponding thereto is set to "1"; and 29, memory means B comprising the second RAM and the second flag memory.

Further in FIG. 7, reference numeral 30 designates input/output means through which data are transmitted between the second CPU 24 and external equipment (hereinafter referred to as "a second I/O port 30", when applicable); 31, a transistor module for driving a 7-segment LED 32 according to signals provided by the arithmetic device B 26; and 32, the aforementioned 7-segment LED which is driven by the transistor module 31 to emit light.

Still further in FIG. 7, reference numeral 33 designates a resistor for limiting the current in the 7-segment LED 32; 37, a connector through which the second I/O port 30 is connected to the display device B 8; 34 and 36, resistors forming means for determining whether or not the display device B has been connected; 38, a display signal applied to the display device B; 39, a signal for determining whether or not the display device B has been connected; and 40, the aforementioned abnormal-phase signal which the arithmetic device A 13 applies to the display device B.

Figure 8:
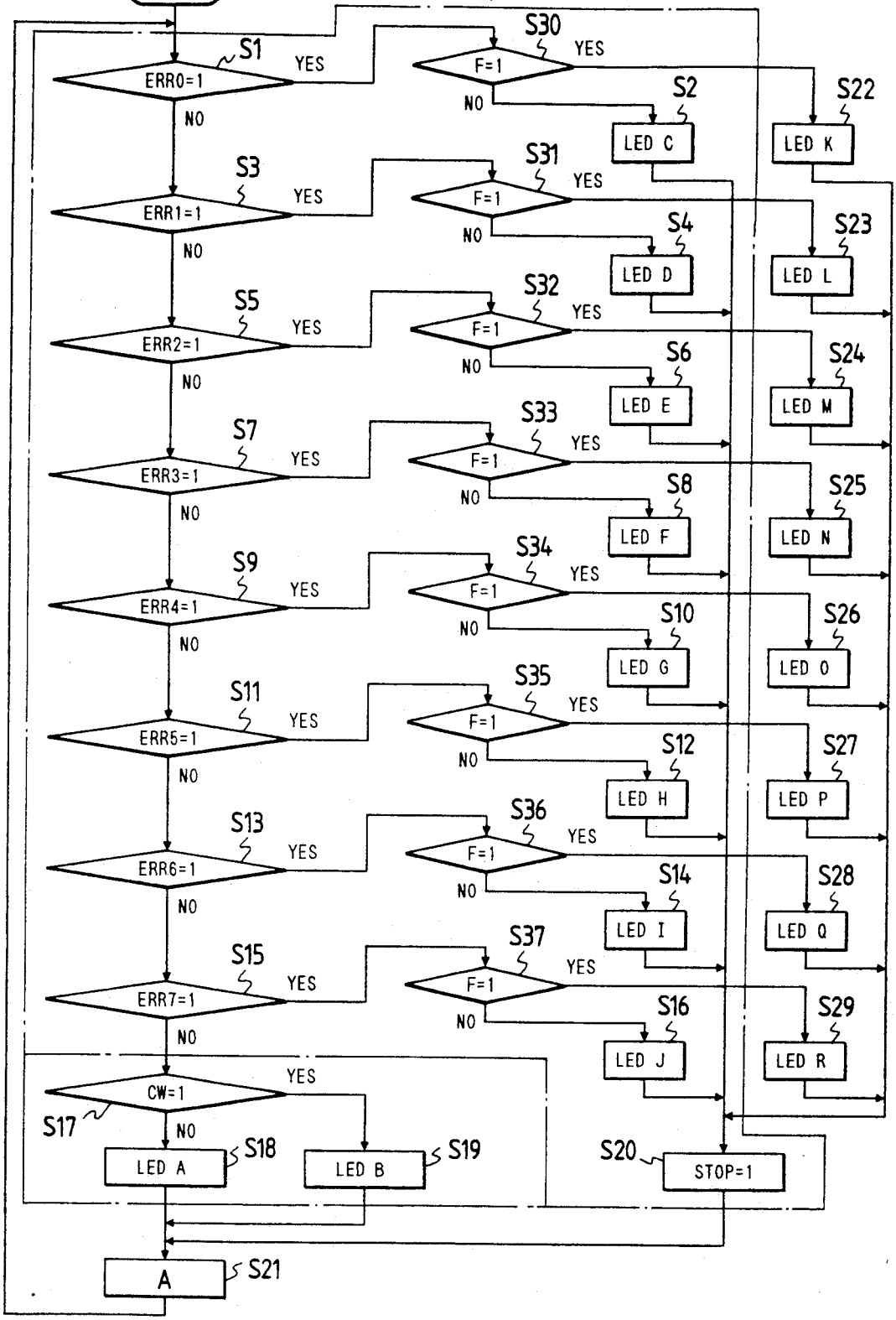

FIG. 8 is a flow chart showing the operation of causing the LED 19 to emit light in a predetermined pattern when the flag is "1" which corresponds to the signal 21 indicating the direction of rotation of the sewing machine or the warning signal provided by any one of the sensors to indicate the occurrences of abnormal conditions.

Figure 9:
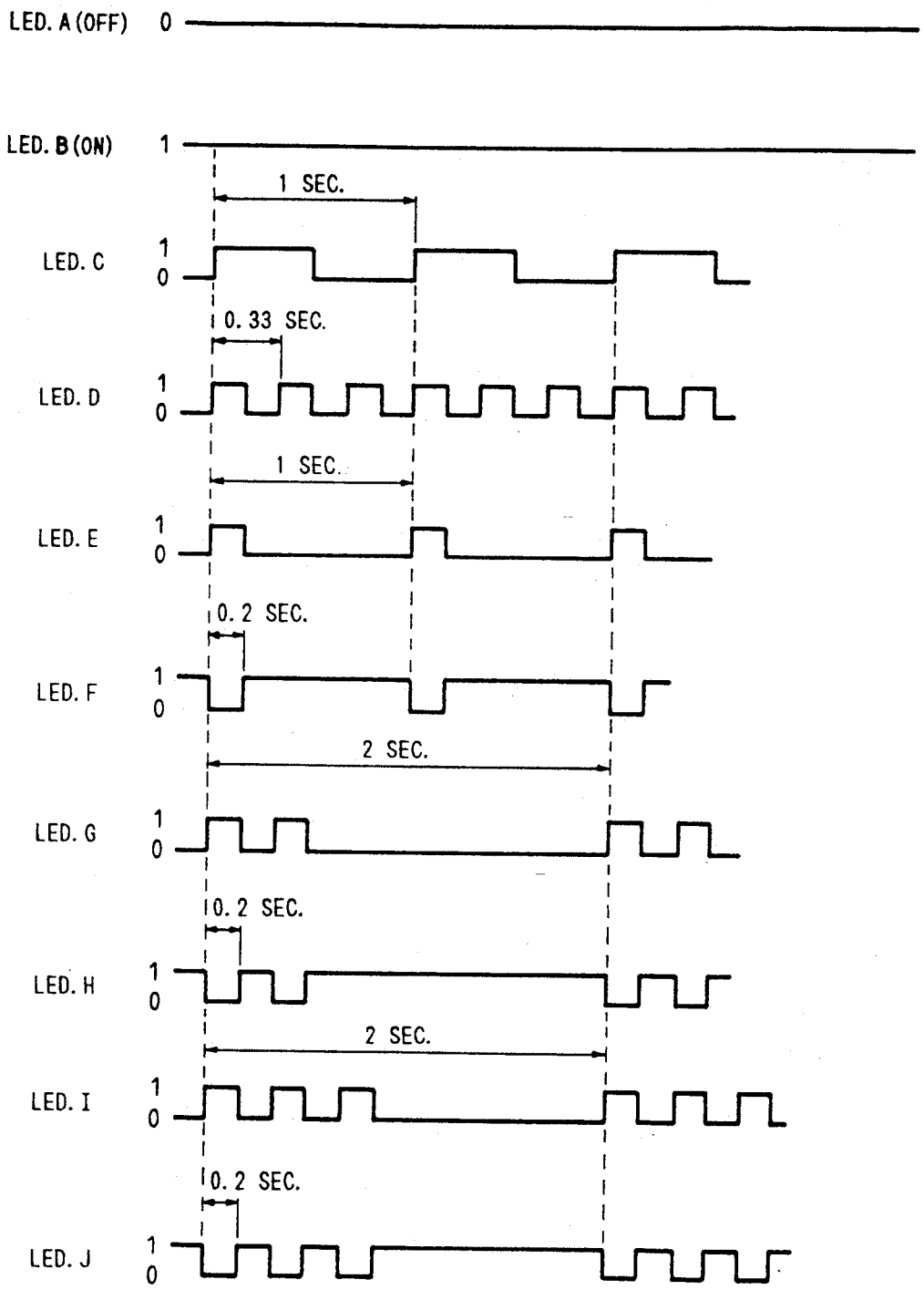

FIG. 9 is a characteristic diagram showing the waveforms of the light emission patterns of the LED 19 which correspond to LED.C through LED. J in FIG. 8. In FIG. 9, reference character LED.A designates the waveform provided when the sewing machine is rotated in the reverse direction; LED.B, the waveform provided when the sewing machine is rotated in the forward direction; and LED.C through LED.J, the light emission waveforms provided in response to the abnormal conditions detected by the sensors, respectively.

Figures 10, 10A:
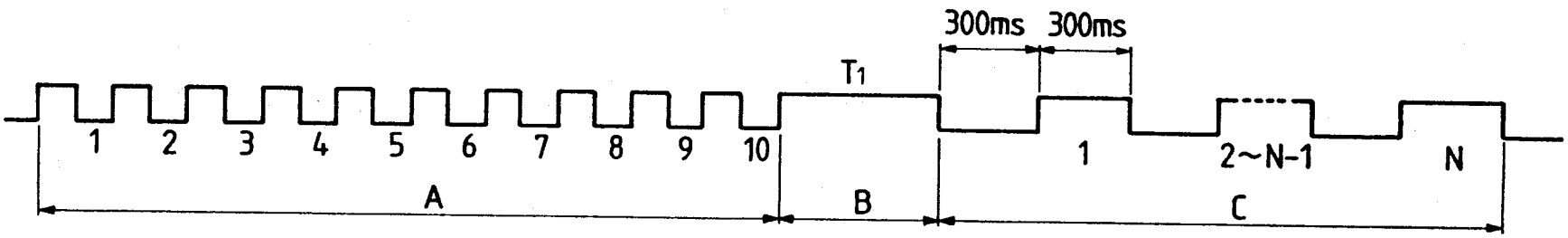

FIGS. 10(*a*) and 10(*b*) show the signal which the arithmetic device A 13 applies to the arithmetic device B in correspondence to LED.K through LED.R in FIG. 8. The signal is provided with the arithmetic device B connected.

The operation of the sewing machine control device thus organized will be described with reference to FIGS. 5 through 11.

The motor 2 is rotated according to the amount of depression of the pedal 4, to drive the sewing machine body 1.

A method of outputting a warning signal in the case where an abnormal condition occurs during the operation of the sewing machine is the same as the conventional method.

The data corresponding to the warning signal 22 is read from the memory means A 16, and the output signal is produced which has the waveform based on the data thus read.

The output signal is as shown in FIG. 9 when the display device B 8 is not connected; and the output signal is as shown in FIG. 10(*a*) when the display device B is connected. This output signal drives the transistor 18, adapted to drive the display device A. Therefore, in the case where the display device B 8 is not connected, the LED 19 is flickered according to the operation of the transistor 18; that is, it is flickered with the period that a person can visually read the flickering of the LED, thus informing the operator of the location of the abnormal condition.

When, on the other hand, the display device B is connected, the output signal is applied through the display device A to the display device B 8 to display characters, symbols, etc. to indicate the occurrence of the abnormal condition.

In this operation, the display device A 7 is also flickered; however, the period of the flickering is too high to read the kind of abnormal condition.

At the same time, the arithmetic device A 13 outputs the stop signal 23 to suspend the operation of the sewing machine.

Now, a method of determining whether or not the display device B 8 has been connected will be described.

The display device B is connected through the connector 37 and the resistor 34 accommodated in the display device B to the power source.

The signal 39 indicating whether or not the display device B 8 is connected is grounded through the resistor 36 in the control device 3.

Hence, in the case when, under this condition, the display device B is connected, the signal 39 is raised to "1"; and when the display device B is not connected, the signal 39 is set to "0".

Now, a method of forming the patterns of light emission of the LED 19 in correspondence to the abnormal conditions detected by the sensors will be described.

When the display device B is not connected, the "0" signal 39 is inputted as was described before, as a result of which the F flag (Steps S30 through S37) is set to "0".

Upon reception of a warning signal 22, in the flag memory 15, the error flag corresponding to the warning signal is set to "1".

The CPU 11 reads the error flags in the flag memory 15 of the memory means A 16 successively, to determine whether each error flag is "1" or "0" (Steps S1, S3, S5, . . . and S15). When finding an error flag which is "1", the CPU 11 operates as required for the flag (Steps S2, S4, S6, . . . and S16).

However, it should be noted that Steps S2, S4, . . . and S16 are affected only when it is determined from the F flag (Steps S30 through S37) that the display device B 8 is not connected.

The kinds of light emission patterns of the LED 19 corresponding to the error flags in the case where the display device B is not connected are as shown in FIG. 9.

The case where the display device B 8 has been connected will be described.

When the display device B has been connected, the "1" signal 39 is inputted as was described before, as a result of which the first and second CPUs 11 and 24 set "1" in the F flags in the first and second RAMs 14 and 27.

A method of reading error flags (Steps S1, S3, . . . and S15; and Steps S22, S23, . . . and S29) is the same as the method described above.

The kinds of light emission patterns of the LED 19 corresponding to the error flags are as described below, and their waveforms are as shown in FIG. 10.

Thereafter, the CPU 11 performs an arithmetic operation "A" to control the sewing machine (Step S21). If, in this case, the stop flag is set to "1", then the stop signal 23 is outputted to stop the sewing machine.

In the case where no abnormal condition occurs with the sewing machine, the method is the same as described before in which the data corresponding to the direction of rotation of the sewing machine is read from the memory means A 16, and the output signal having the waveform corresponding to the data is produced to form a light emission pattern of the LED 19.

Error signals LED.K through LED.R corresponding to the warning signals displayed by the LED 19 are applied through the second I/O port 30 to the arithmetic device B 26.

As shown in FIG. 10(*a*) the signal includes three waveforms A, B and C.

More specifically, the waveform A is the signal to cause the arithmetic device B 16 to detect the inputting of an error signal. The signal A is set to "1" and "0" alternately ten times.

The waveform B is the signal which, as shown in FIG. 10, changes its duration time depending on the error signal, whereby the arithmetic device B 26 recognizes the kind of error signal.

The waveform C provides the same effect as the waveform B. However, in the case of the waveform C, the kind of error is determined from the number of repetition of "0" and "1".

Thus, the arithmetic device B 26 determines the kind of error, and in the flag memory 27, the flag corresponding to the kind of error thus determined is set to "1" in advance.

Figure 11:
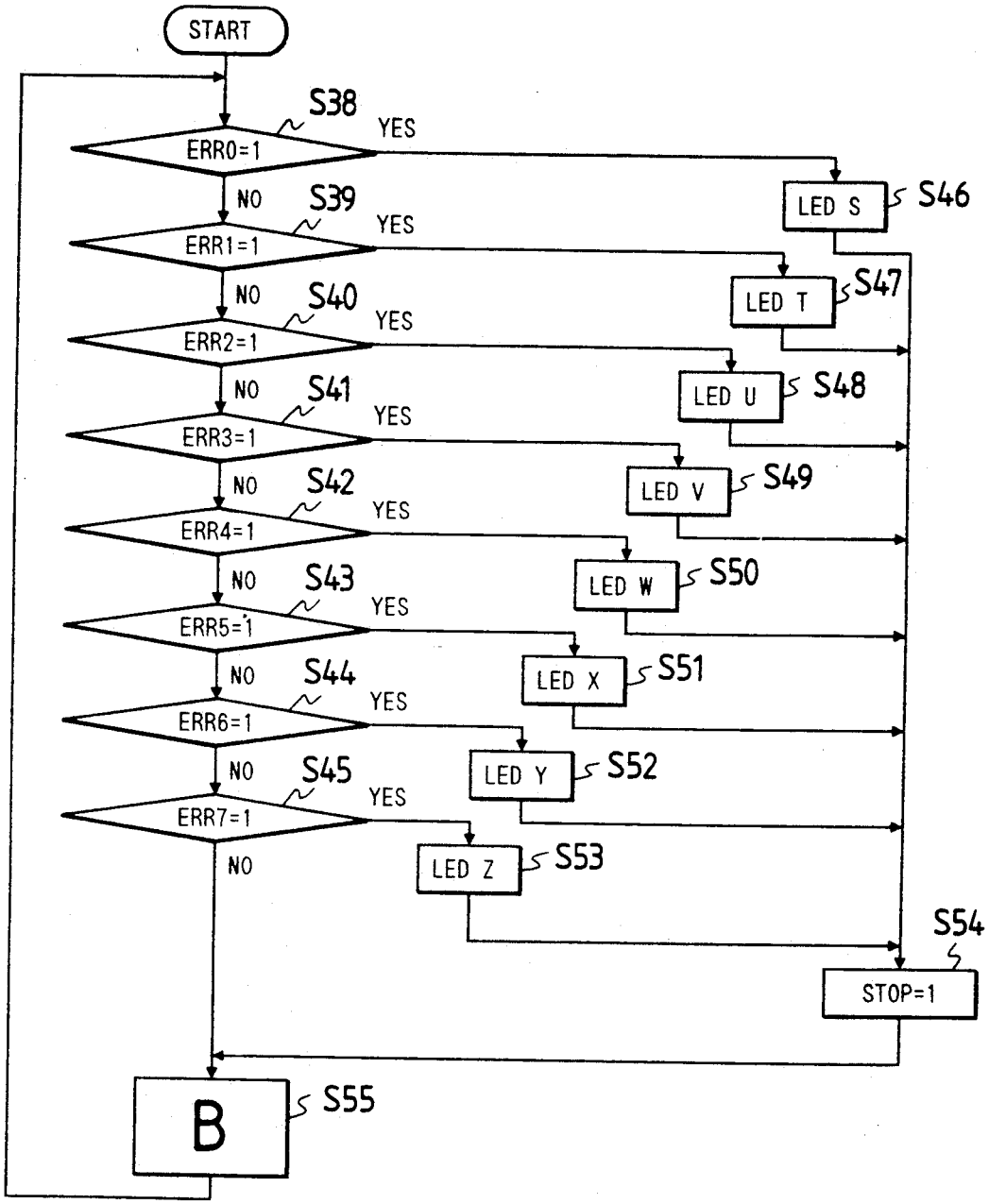

The operation of the arithmetic device B 26 will be described with reference to a flow chart of FIG. 11.

The second CPU 24 reads the error flags in the second flag memory 28 sequentially to detect whether each error flag is "1" or "0" (Steps S38 through S45). Upon detection of a "1" error flag, the second CPU 24 performs an operation as required for the error flag (Steps S46 through S53).

For instance when the error flag ERR3 is "1" (Step S41), the second CPU 24 reads the data corresponding to the error flag ERR3 from the second flag memory 28 in the memory means B 29, and outputs the signal 38 through the second I/O port 30 which is based on the data.

The output signal 38 is applied through the connector 37 to the transistor module 31 in the display device B 8, so that it is displayed by the 7-segment LED 32 according to a table of FIG. 12.

Thereafter, the second CPU 24 performs an arithmetic operation "B" (Step S55). However, if, in this case, the stop flag is "1", the operation is not carried out.

In the above-described embodiment, the display device A has been provided in advance, and it is detected whether or not the display device B has been connected. However, it goes without saying that the technical concept of the invention can be applied to the case where, in contrast, the display device B has been provided in advance, and it is detected whether or not the display device A has been connected.

Furthermore in the above-described embodiment, the display device A 7 employs the LED 19; however, instead of the LED, a lamp or the like may be employed to indicate the direction of rotation of the sewing machine and the occurrences of abnormal conditions. In addition, any other means can be employed through which a person can recognize those facts: the direction of rotation of the sewing machine and the occurrences of abnormal conditions.

It is needless to say that the directions of rotation of the sewing machine can be indicated by flickering the LED or lamp.

In the above-described embodiment, the LED 19 operates in ten light emission patterns; however, this function can be achieved by providing two light emission patterns indicating the directions of rotation of the sewing machine and one light emission pattern indicating the occurrence of an abnormal condition.

In addition, in the invention, the number of light emission patterns is not limited; that is, more than ten light emission patterns may be employed as long as a person can read them.

It goes without saying that the display device B 8 may employ display means (such as a liquid crystal display unit LCD) which a person can read with ease.

In the above-described embodiment, the resistor is employed to automatically detect when the display device B is connected: however, any other means capable of determining whether or not the display device B has been connected may be employed.

Furthermore, it is needless to say that, instead of the above-described method of automatically detecting the connection of the display device B 8, a dip switch which is manually operated may be employed for the same purpose.

As was described above, in the invention, the warning signals outputted by the sensors to indicate the occurrences of abnormal conditions with the sewing machine are displayed in the light emission patterns flickering with the periods predetermined respectively for the abnormal conditions. Hence, a plurality of abnormal conditions can be displayed with only one display unit, with the results that the space required for the display device can be reduced, and accordingly the manufacturing cost of the sewing machine control device can be also reduced as much.

Furthermore, the control device has the function of completely indicating the direction of rotation of the sewing machine according to the invention. Hence, the difficulty is eliminated that the sewing machine is continuously rotated in the reverse direction to damage itself.

Furthermore, according to the invention, the display device can display the abnormal conditions by flickering the light and/or by using characters, symbols, etc. with ease. Hence, the operator can readily and quickly detect the of abnormal conditions of the sewing machine. Thus, the sewing machine control device of the invention is excellent in operability.

What is claimed is:

1. A sewing machine monitoring device, comprising:

memory means for storing data representing operation indicative conditions of a sewing machine;

an arithmetic device receiving a plurality of signals representing said operation indicative conditions from sensors provided for said sewing machine, said arithmetic device, upon reception of any one of said signals, reading the data corresponding to said one signal from said memory means to provide an output signal having a predetermined waveform based on said data corresponding to the operation indicative condition of the sewing machine; and a display device actuating at least one display unit according to the waveform of said output signal provided by said arithmetic device so as to display the condition, wherein said arithmetic device reads said data or provides said output signals having predetermined waveforms based on said data in a predetermined order of priority.

2. A sewing machine monitoring device comprising:

memory means in which data corresponding to the direction of rotation and abnormal conditions of a sewing machine have been stored;

an arithmetic means which is adapted to receive signals indicating the direction of rotation of said sewing machine and a plurality of warning signals indicating abnormal conditions of said sewing machine, and which, upon reception of any one of said warning signals, reads data corresponding to said one warning signal from said memory means to provide an output signal having a predetermined waveform based on said data thus read, and reads, when no warning signal is received, data corresponding to the current direction of rotation of said sewing machine from said memory means, to provide an output signal having a predetermined waveform based on said data thus read; and a display device which turns on or off a display unit according to the waveform of said output signal provided by said arithmetic device, or repeatedly flickers said display unit with a period according to the waveform of said output signal.

3. A sewing machine monitoring device as claimed in claim 2, wherein said display unit is one light emitting element.

4. A sewing machine monitoring device as claimed in claim 2, wherein said display device is arranged below a sewing machine table.

5. A sewing machine monitoring device coupled with a plurality of sewing machine sensors for sensing operation indicative conditions of a sewing machine, the monitoring device comprising:

a first display device mounted on a sewing machine, said first displaying device flickering repeatedly with predetermined periods to display operation indicative conditions of said sewing machine in response to a display output signal;

a second display device arranged near said first display device, for displaying the operation indicative conditions of said sewing machine by using characters, symbols, or other indicia in response to a display output signal;

memory means in which first data have been stored for application to said first display device to flicker said first display device in correspondence to operation indicative conditions of said sewing machine, and second data have been stored as display data for said second display device; and an arithmetic device which receives a plurality of condition signals indicating the operation indicative conditions of said sewing machine from said plurality of sewing machine sensors, and which, upon reception of any one of said condition signals with said first or second display device not connected to the sewing machine monitoring device, reads data corresponding to said condition signal indicating an operation indication condition out of said second or first data in said memory means, to apply a display output signal based on said data thus read to said second or first display device, and upon reception of any one of said condition signals with said first and second display devices connected, reads data corresponding to said one condition signal indicating an operation indication condition from said first and second data in said memory means, to produce an output signal based on said data thus read as display data for said first and second display devices.

6. A sewing machine monitoring device comprising:

a first display device arranged below the table of a sewing machine, said first display device repeatedly flickering with predetermined periods to display abnormal conditions of said sewing machine;

memory means in which first data have been stored for application as signals to flicker said first display device in correspondence to abnormal conditions of said sewing machine, and in which second data have been stored for application as signals higher in frequency than said signals for flickering said first display device in correspondence to the abnormal conditions of said sewing machine;

a second display device which is arranged above the table of said sewing machine for displaying abnormal conditions of said sewing machine by using characters, symbols, or other indicia; and an arithmetic device which receives a plurality of warning signals indicating abnormal conditions of said machine from sensors, and which, upon reception of any one of said warning signals with said second display device not connected to the monitoring device, reads data corresponding to said warning signal condition from said first data in said memory means, to apply a signal based on said data thus read to said first display device, and upon reception of any one of said warning signals with said second display device connected, reads data corresponding to said warning signal from said second data in said memory means, to apply a signal based on said data thus read as display data for said second display device.

7. A sewing machine monitoring device comprising:

a first display device mounted on a sewing machine, said first display device flickering with predetermined periods to display operation indicative conditions of said sewing machine;

a second display device provided near said first display device, for displaying the operation indicative conditions of said sewing machine;

detecting means for detecting whether one of said first and second display devices has been connected or whether both of said first and second display devices have been connected; and an arithmetic device which, when said detecting means has detected the fact that only one of the said first and second display devices has not been connected, receives signals indicating the operation indicative conditions of said sewing machines from sensors, and applies signals to said one display device connected which are based on data corresponding to said one display device connected.

8. A sewing machine control device as claimed in claim 7, wherein with both said first and second display devices connected, said arithmetic device produces signals based on data corresponding to said first and second display devices as display data for said first and second display devices, respectively.

9. A sewing machine control device as claimed in claim 7, wherein said signals indicating the operation indicative conditions of said sewing machine are signals indicating the direction of rotation and/or abnormal conditions of said sewing machine.

10. A sewing machine control device as claimed in claim 9, wherein said signals indicating the abnormal conditions of said sewing machine are handled in preference to said signals indicating the direction of rotation of said sewing machine.

11. A sewing machine control device as claimed in claim 7, wherein said arithmetic device produces said output signals in an order of priority predetermined for said operation indicative conditions.

* * * * *